US005240380A

United States Patent [19]

Mabe

[11] Patent Number: 5,240,380

[45] Date of Patent: Aug. 31, 1993

[54] VARIABLE SPEED CONTROL FOR CENTRIFUGAL PUMPS

[75] Inventor: William J. Mabe, Thornton, Colo.

[73] Assignee: Sundstrand Corporation, Rockford, Ill.

[21] Appl. No.: 703,761

[22] Filed: May 21, 1991

[51] Int. Cl.[5] ..... F04D 15/00

[52] U.S. Cl. ..... 417/43; 417/45

[58] Field of Search ..... 417/20, 43, 44, 45

[56] References Cited

U.S. PATENT DOCUMENTS

| | | | |
|---|---|---|---|
| 3,551,072 | 12/1970 | Zimmerly | 417/45 |
| 4,108,574 | 8/1978 | Bartley et al. | 417/19 |
| 4,201,925 | 5/1980 | Kuwabara et al. . | |
| 4,212,590 | 7/1980 | Johnsson | 417/24 |
| 4,248,194 | 2/1981 | Drutchas et al. . | |
| 4,253,794 | 3/1981 | Kuwabara . | |
| 4,354,800 | 10/1982 | Kuwabara . | |
| 4,370,098 | 1/1983 | McClain et al. | 417/45 |
| 4,382,745 | 5/1983 | Kuwabara et al. . | |
| 4,474,528 | 10/1984 | Yokoyama . | |
| 4,595,342 | 6/1986 | Christlieb et al. . | |
| 4,610,599 | 9/1986 | Long . | |
| 4,678,404 | 7/1987 | Lorett et al. | 417/53 |
| 4,694,189 | 9/1987 | Haraguchi et al. . | |
| 4,708,594 | 11/1987 | Shinmei et al. . | |
| 4,754,156 | 6/1988 | Shiozaki et al. . | |
| 5,026,256 | 6/1991 | Kuwabara et al. | 417/45 |

FOREIGN PATENT DOCUMENTS

| | | | |
|---|---|---|---|
| 48-21045 | 3/1973 | Japan | 417/45 |
| 61-149583 | 7/1986 | Japan . | |
| 61-173698 | 8/1986 | Japan . | |
| 61-175271 | 8/1986 | Japan . | |
| 62-18069 | 1/1987 | Japan . | |
| 1140128 | 1/1969 | United Kingdom . | |
| 2124304 | 2/1984 | United Kingdom | 417/18 |

*Primary Examiner*—Richard A. Bertsch
*Assistant Examiner*—David W. Scheuermann
*Attorney, Agent, or Firm*—Antonelli, Terry, Stout & Kraus

[57] ABSTRACT

A control system (10) for a variable speed centrifugal pump (12) in which pump pressure as a function of flow rate for a constant speed of operation of the pump has a range of flow rates in which the pump pressure increases as a function of increasing flow rate which is unstable in accordance with the invention includes a sensor (14) for sensing an operational parameter of an output flow pumped by the pump; a variable speed drive (16) for driving the pump at a commanded rotational speed in response to a commanded speed signal; and a controller (22), responsive to the sensed operational parameter, for producing the commanded speed signal (N) as a function of pump speeds at which the pump pressure does not increase with increasing flow rate.

14 Claims, 2 Drawing Sheets

VARIABLE SPEED CONTROL FOR CENTRIFUGAL PUMPS

DESCRIPTION

1. Technical Field

The present invention relates to centrifugal pumps and controls for centrifugal pumps having an unstable region of operation pertaining to the pump head as a function of flow.

2. Background Art

FIG. 1 illustrates a family of constant speed curves N1–N7 each representing the head of a centrifugal radial bladed impeller pump as a function of flow. Each of the constant speed curves N1–N7 has a region of stable operation to the right of the "X" intersecting each curve N1–N7 which is characterized by a negative slope of the head as a function of flow rate. An unstable region of operation to the left of the "X" intersecting each curve N1–N7 is characterized by a positive slope of head as a function of flow. The region of instability can be shown to be mathematically unstable where a system resistance curve intersects the positive sloped region of the curve to the left of the "X" of the individual curves N1–N7. If a radial bladed impeller pump is operated in the unstable region to the left of the "X" intersecting the individual curves N1–N7, the instability will cause large variations in output pressure and flow rates which can lead to destructive pump and piping vibrations if a system natural resonance is excited by the characteristic frequency of the large variations.

FIG. 2 illustrates a prior art solution to preventing operation of centrifugal pumps in the unstable region to the left of the "X's" intersecting the curves N1–N7. The prior art approach utilizes a feedback circuit which functions to feedback part of the discharged output of the pump through a control valve back to the inlet of the pump. The opening of the control valve is controlled by a controller to avoid the region of instability. The bypass of FIG. 2 reduces the efficiency of the pump by consuming excess output by feeding back part of the discharged output to the input to avoid operation in the unstable range.

DISCLOSURE OF THE INVENTION

The present invention is a control system for a variable speed centrifugal pump and a variable speed centrifugal pumping system. The pump for a constant speed of operation has a range of flow rates in which the pump pressure increases as a function of increasing flow rate which is unstable which does not suffer from the deficiencies of the prior art discussed above. With the invention, a controller controls the velocity at which the pump is driven in response to a sensed operational parameter of pump operation, which may be the output flow rate or pressure of the pump, to change the speed of the pump so that the pump operates with an operational characteristic of head as a function of flow which has a negative slope or is varied from a characteristic when the pump is operated at constant speed to vary flow rate. Operation of the centrifugal pump in response to a sensed operational parameter with a speed which varies so that the head as a function of flow rate has as a negative slope prevents operation in the unstable range described above in conjunction with the prior art. With the invention, the controller may store an equation expressing pump velocity as a function of flow rate which is solved in response to the sensed operational parameter of the pump to produce a commanded velocity signal which controls the velocity at which the pump is driven to operate it in the stable region defined by a negative slope or the controller may store a table of individual velocities each associated with a particular flow rate or sensed pressure which, upon matching with the sensed operational parameter, the associated velocity outputted as the commanded velocity signal controls the velocity at which the pump is operated to operate it in the stable region.

While the preferred embodiment of the present invention is used for preventing unstable pump operation where the output pressure increases with flow rate, the invention may also be used to alter the operational characteristic of the pump such that changes in flow rate are produced by commanding a velocity at which the pump is operated in response to a sensed operational parameter of the pump.

A control system for a variable speed centrifugal pump operative throughout a flow range extending from a minimum to a maximum flow rate in which pump pressure as a function of flow rate for a constant speed of operation of the pump has a range of flow rates in which the pump pressure increases as a function of increasing flow rate which is unstable in accordance with the invention includes a sensor for sensing an operational parameter of an output flow pumped by the pump; a variable speed drive for driving the pump at a commanded rotational speed in response to a commanded speed signal; and a controller, responsive to the sensed operational parameter, for producing the commanded speed signal as a function of pump flow to vary pump speed from a speed producing the flow rates in which the pump pressure increases as a function of flow rate to a commanded speed producing operation throughout the flow range to produce only flow rates for which pump pressure decreases as a function of flow rate to produce stable operation. The controller utilizes an equation expressing pump speed as a function of flow rate which is solved by the controller in response to the operational parameter to produce the commanded speed signal or a table of individual speeds each associated with a flow rate with the controller producing the commanded speed signal by matching the operational parameter to a flow rate and outputting the speed, associated with the matched flow rate, as the commanded speed signal. The operational parameter may be flow rate. The variable speed drive comprises a variable speed electric motor for driving the centrifugal pump; and an electrical power drive for supplying an electrical power signal to the variable speed electric motor to cause the electric motor to rotate at the commanded rotational speed produced by the controller. The pump may have an impeller with radial blades.

Furthermore, the present invention is comprised of a system including a variable speed centrifugal pump in which pump pressure as a function of flow rate for a constant speed of operation of the pump has a range of flow rates in which the pump pressure increases as a function of increasing flow rate which is unstable and a sensor, variable speed drive and controller as described above.

A control system for a variable speed centrifugal pump in which pump pressure as a function of flow rate is defined by a group of constant speed characteristics in which each constant speed characteristic defines pressure as a function of flow rate in accordance with the invention includes a sensor for sensing an operational parameter of an output flow pumped by the pump; a variable speed drive for driving the pump at a commanded rotational speed in response to a commanded rotational speed signal; and a controller, responsive to the sensed operational parameter, for producing the commanded speed signal to cause the speed of the pump to vary to produce an operation in which pump pressure as a function of flow is different than the pressure as a function of flow rate during operation at the constant speed characteristics for flow rates which may be pumped by the pump while producing stable operation. Furthermore, the invention includes a system including a variable speed centrifugal pump with the foregoing control system.

BEST MODE FOR CARRYING OUT THE INVENTION

Figure 1:
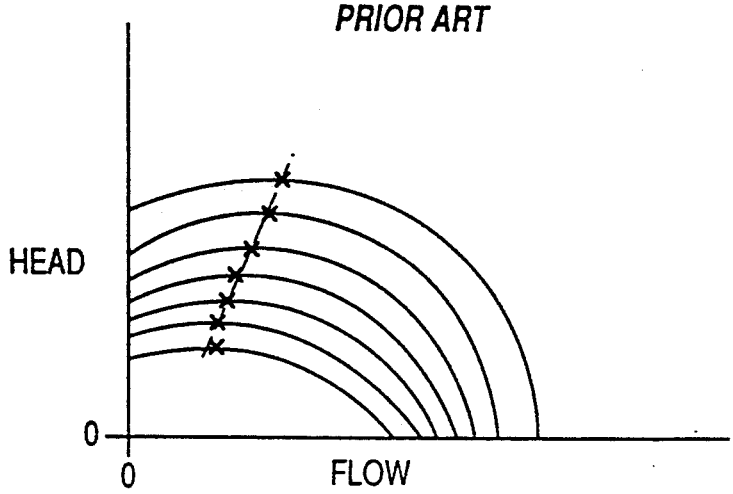
FIG. 1 PRIOR ART
FIG. 1 illustrates the prior art operational characteristic of a centrifugal pump with radial bladed impellers.
Figure 2:
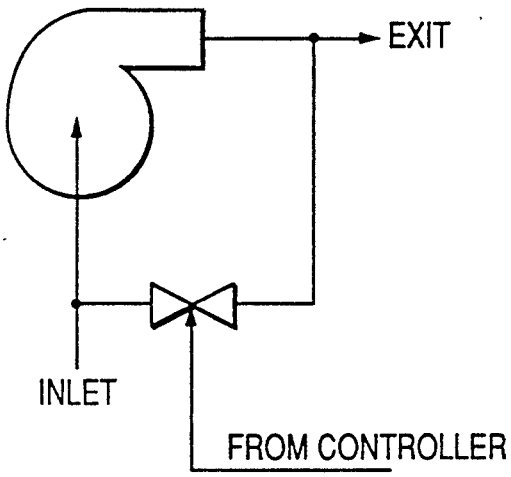
FIG. 2 PRIOR ART
FIG. 2 illustrates a prior art system for avoiding unstable operation produced by the operational characteristic of FIG. 1.
Figure 3:
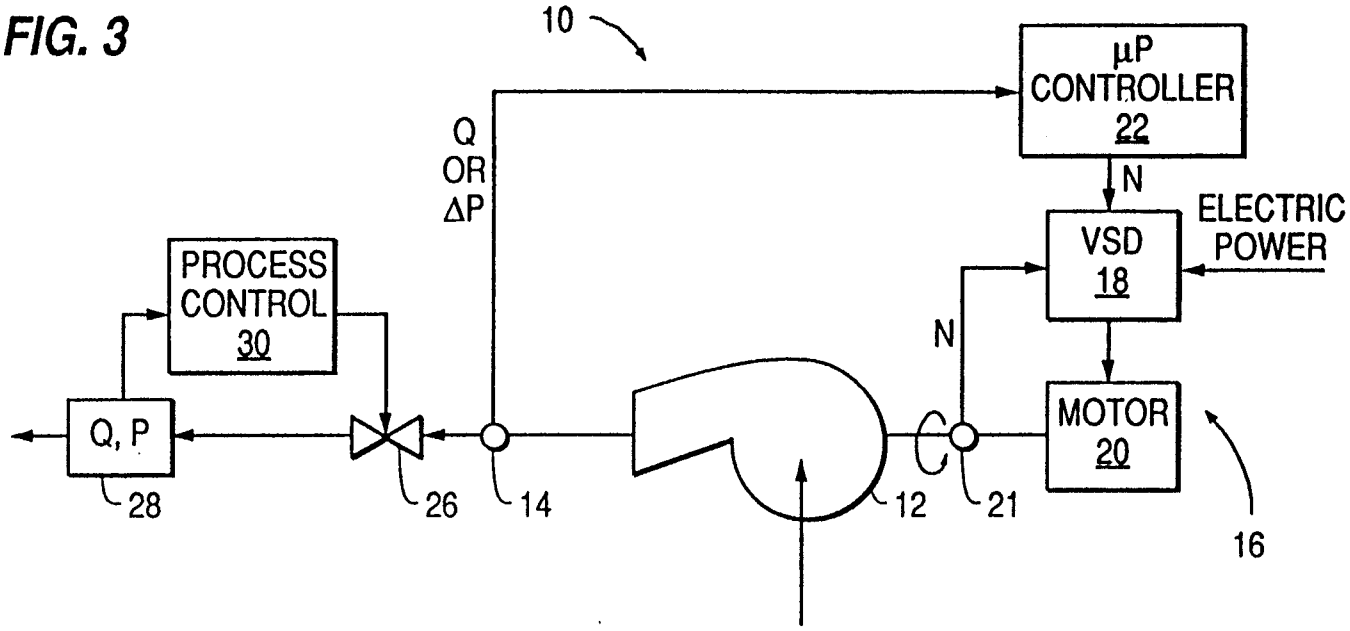
FIG. 3 illustrates a system in accordance with the present invention including a centrifugal pump.

FIG. 3 illustrates an embodiment 10 of the present invention which controls a centrifugal pump in which the pump pressure does not increase with increasing flow rate such as with reference to the prior art of FIG. 1. A centrifugal pump 12 which may be, but is not limited to, a pump having a radial bladed impeller, has an operational characteristic in which pump pressure as a function of flow rate for a constant speed operation of the pump has a range of flow rates in which the pump pressure increases as a function of increasing flow rate which is unstable. This characteristic is like the characteristic of the prior art of FIG. 1 to the left of the "X's" in the curves N1–N7. Without the control system of the present invention described below, variation of the velocity of the pump results in operation of the pump having a head as a function of flow which is along one of a family of curves such as curves N1–N7 of FIG. 1. Sensor 14 senses an operational parameter of an output flow pumped by the pump. The operational parameter may be, without limitation, the sensed flow output from the pump or the pressure of the fluid being pumped from the pump. A variable speed drive 16 controls the velocity of the impeller (not illustrated) of the pump to operate in accordance with a commanded velocity. The variable speed drive, while not limited thereto, is a variable speed electrical drive 18 and associated motor 20 which varies the rotational velocity of the motor driving the pump in accordance with a commanded velocity N produced by microprocessor controller 22. Speed sensor 21 provides a signal representative of speed N to the variable speed electrical drive. The design of the variable speed drive 18 and motor 20 are not part of the present invention. By way of example, the variable speed drive 18 may be an inverter driving an induction motor 20. The variable speed drive 18 provides a variable frequency electrical power having a voltage which is controlled to cause the motor to rotate at the desired commanded speed N. The present invention is not limited to the form of variable speed drive 18 and motor 20. Furthermore, the present invention may be practiced with other forms of power sources, such as pneumatic or hydraulic drives.

Figure 4:
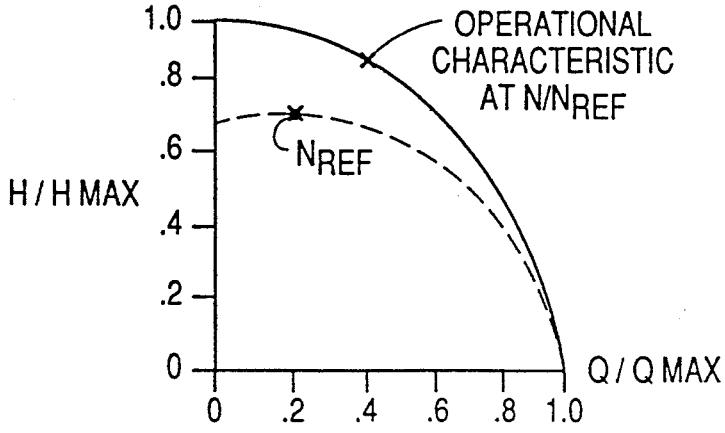
FIG. 4 illustrates a control characteristic of a preferred embodiment of the present invention.

The speed N which is commanded by the microprocessor controller 22 may be produced in a number of different ways. The overall control characteristic is illustrated in FIG. 4 by the solid curved line which expresses pump head normalized to maximum pump head as a function of flow rate normalized to maximum flow rate with a non-positive slope. It should be noted that the operational characteristic does not have the positive sloped instability associated with the prior art of FIG. 1 to the left of the "X's" of the characteristic curves N1–N7.

A first way of producing the operational characteristic of FIG. 4 is with an equation expressing pump velocity as a function of flow rate which is solved by the controller 22 in response to the operational parameter to produce the commanded velocity signal N. The equation is identified by the solid line in FIG. 5 which expresses the commanded speed of the pump normalized to a reference speed $N_{REF}$ from which data is extrapolated in a manner described below as a function of flow rate normalized by maximum flow rate QMAX. The output flow rate or pressure sensed by sensor 14 is matched to a stored flow ate or converted to a stored flow rate by the controller 22 if the sensed parameter is pressure and the controller solves for the desired speed N from the equation illustrated in FIG. 5. The solid line equation illustrated in FIG. 5 results in the solid line operational characteristic of FIG. 4.

Another way in which the controller 22 expresses the function of pump velocities at which pump pressure does not increase with increasing flow rate is a table of individual velocities each associated with a flow rate. The controller 22 produces the commanded velocity signal by matching the operational parameter from sensor 14 to a flow rate and outputting the velocity, associated with the matched flow rate as the commanded velocity signal. If the sensed operational parameter produced by the sensor 14 is flow rate, then the commanded velocity N may be produced by reading out the stored velocity associated with the stored flow rate which matches the flow rate sensed by sensor 14. If the sensor 14 senses pressure, then the microprocessor controller 22 converts the sensed pressure into a corresponding flow rate. The conversion may be done by empirical measurements or by equations depending upon the characteristics of the system.

A control system for a centrifugal pump and a system including a centrifugal pump and control system of the present invention has diverse applications. FIG. 3 illustrates a possible application in which the output from the pump 12 is applied to a valve 26 which controls the flow rate to a flow rate and pressure sensor 28 which provides a sensed flow rate and pressure to a process control 30 which controls the opening of valve 26 in accordance with a stored program. The invention is not limited to any particular field of application with the foregoing system being only exemplary of possible applications.

Figure 5:
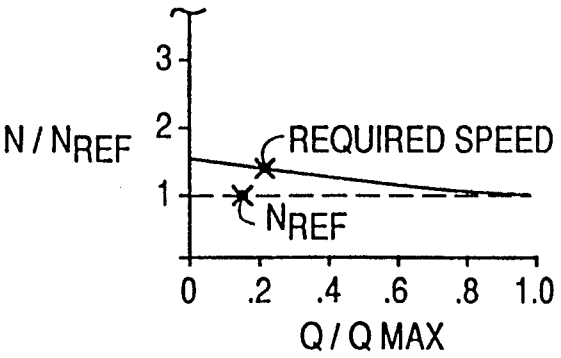
FIG. 5 illustrates a speed characteristic of the centrifugal pump of FIG. 3 for achieving the operational characteristic of FIG. 4.

The operational characteristic of FIG. 4 is preferably expressed as a parabolic or quadratic equation, but it should be understood that the present invention is not limited thereto. It is possible to determine the speed at each flow point on the operational characteristic by trial and error along the desired operational characteristic of FIG. 4 by using the affinity laws and the dotted line reference head flow curve of FIG. 4 with empirical data obtained for $N_{REF}$ by testing of the pump. The values of the required speed N to generate the operational characteristic as a function of flow can then be tabulated or mathematically fit. Alternatively, the microprocessor may be programmed to determine a speed-flow curve as illustrated in FIG. 5 which passes through $N_{REF}$ at the maximum flow QMAX for any input value of HMAX which provides a continuously rising curve as illustrated in FIG. 5.

In operation, the flow signal or pressure sensed by sensor 14 is continuously inputted to the microprocessor controller 22. The microprocessor controller 22 converts the sensed data to a commanded speed signal N according to the predetermined flow relationship which may be in the form of the equation of FIG. 5 or, alternatively, a plurality of stored flows and associated pump speeds. The commanded speed N is applied to the variable speed drive 16 which, as illustrated in the form of an electrical drive, varies the frequency and voltage of the current applied to the motor 20 to cause the pump to be driven at the commanded speed N. Thus it is seen that the microprocessor controller 22 continuously commands the variation of the speed of the motor as a function of the sensed operational parameter sensed by sensor 14 to produce an operational characteristic as in FIG. 4 instead of operating along the constant speed curves of the prior art of FIG. 1.

While a preferred embodiment of the present invention is the control of a centrifugal pump to eliminate unstable operation as described above with respect to the prior art of FIG. 1, it should be understood that the invention may be used in wider fields of application where a sensed operational parameter is processed by the controller 22 to cause the velocity of the pump to vary to produce operation of the pump in which pressure as a function of flow is different than the pump pressure as a function of flow rate operational characteristics for constant velocity as illustrated in FIG. 1. The invention may be used to produce a linear, quadratic or other form of mathematical control of pump pressure as a function of flow than that illustrated in FIG. 4 and is not limited to elimination of unstable operation. As a result, control of the speed of the pump may be used as the independent control variable to control the output flow of the pump in accordance with sensed operational parameters of the output of the pump without operation on constant speed curves.

While the invention has been described in terms of its preferred embodiments, it should be understood that numerous modifications may be made thereto without departing from the spirit and scope of the invention as defined in the appended claims. It is intended that all such modifications fall within the scope of the appended claims.

I claim:

1. A control system for a variable speed centrifugal pump operative throughout a flow range extending from a minimum to a maximum flow rate in which pump pressure as a function of flow rate for a constant speed of operation of the pump has a range of flow rates in which the pump pressure increases as a function of increasing flow rate which is unstable comprising:

a sensor in fluid communication with output flow pumped from the pump for sensing only a single operational parameter of the output flow pumped by the pump;

a variable speed drive for driving the pump at a commanded rotational speed in response to a commanded speed signal; and a controller, responsive to the sensed operational parameter, for producing the commanded speed signal as a function of pump flow to vary pump speed from a speed producing the flow rates in which the pump pressure increases as a function of increasing flow rate to the commanded rotational speed to produce pump operation throughout the flow range to produce only flow rates for which pump pressure decreases as a function of increasing flow rate to produce stable pump operation.

2. A control system in accordance with claim 1 wherein:

the pump has an impeller with radial blades.

3. A control system in accordance with claim 1 wherein the variable speed drive comprises:

a variable speed electric motor for driving the centrifugal pump; and an electrical power drive for supplying an electrical power signal to the variable speed electric motor to cause the electric motor to rotate at the commanded rotational speed.

4. A control system in accordance with claim 1 wherein:

the operational parameter is flow rate.

5. A control system in accordance with claim 1 wherein:

the controller utilizes an equation expressing pump speed as a function of flow rate which is solved by the controller in response to the operational parameter to produce the commanded speed signal.

6. A control system in accordance with claim 5 wherein:

the operational parameter is flow rate.

7. A control system in accordance with claim 1 wherein:

the controller utilizes a table of individual speeds each associated with a flow rate with the controller producing the commanded speed signal by matching the operational parameter to a flow rate and outputting the speed, associated with the matched flow rate, as the commanded speed signal.

8. A control system in accordance with claim 7 wherein:

the operational parameter is flow rate.

9. A system comprising:

a variable speed centrifugal pump operative throughout a flow range extending from a minimum to a maximum flow rate in which pump pressure as a function of flow rate for a constant speed of operation of the pump has a range of flow rates in which the pump pressure increases as a function of increasing flow rate which is unstable;

a sensor in fluid communication with output flow pumped from the pump for sensing only a single operational parameter of the output flow pumped by the pump;

a variable speed drive for driving the pump at a commanded rotational speed in response to a commanded speed signal; and a controller, responsive to the sensed operational parameter, for producing the commanded speed signal to vary the speed of the pump as a function of pump flow to vary pump speed from a speed producing the flow rates in which the pump pressure increases as a function of increasing flow rate to the commanded rotational speed to produce pump operation throughout the flow range to produce only flow rates for which pump pressure decreases as a function of increasing flow rate to produce stable pump operation.

10. A control system in accordance with claim 9 wherein:

the operational parameter is flow rate.

11. A control system in accordance with claim 1 wherein:

the controller utilizes a table of individual speeds each associated with a flow rate with the controller producing the commanded speed signal by matching the operational parameter to a flow rate and outputting the speed, associated with the matched flow rate, as the commanded speed signal.

12. A control system in accordance with claim 11 wherein:

the operational parameter is flow rate.

13. A control system in accordance with claim 9 wherein:

the controller utilized an equation expressing pump speed as a function of flow rate which is solved by the controller in response to the operational parameter to produce the commanded speed signal.

14. A control system in accordance with claim 13 wherein:

the operational parameter is flow rate.

* * * * *